US005603605A

United States Patent [19]

Fonda-Bonardi

[11] Patent Number: 5,603,605

[45] Date of Patent: Feb. 18, 1997

[54] DIFFUSER

[76] Inventor: G. Fonda-Bonardi, 2075 Lida Flora Dr., Los Angeles, Calif. 90077

[21] Appl. No.: 625,194

[22] Filed: Apr. 1, 1996

[51] Int. Cl.[6] ..... F01D 25/30

[52] U.S. Cl. ..... 415/211.2; 415/914

[58] Field of Search ..... 415/211.2, 914, 415/220; 60/39.5, 39.52

[56] References Cited

U.S. PATENT DOCUMENTS 3,599,431 8/1971 Fonda-Bonardi ..... 60/264
4,029,430 6/1977 Fonda-Bonardi ..... 417/87

FOREIGN PATENT DOCUMENTS 834474 4/1952 Germany ..... 415/211.2
141488 1/1961 U.S.S.R. ..... 415/914

*Primary Examiner*—James Larson
*Attorney, Agent, or Firm*—J. E. Brunton

[57] ABSTRACT

A diffuser apparatus for use in connection with gas turbines which will markedly increase the fuel efficiency of the turbine. The apparatus is specially designed for use with a gas turbine having both inner and outer walls on which a boundary layer develops and can become detached. The apparatus includes a strategically located capture scoop for capturing a portion of the high velocity gas stream of the gas turbine in the area of maximum velocity and redirecting it through a plurality of spaced-apart injector slots provided in both the inner and outer walls of a shroud which is positioned relative to the turbine in a manner to capture the high velocity gas stream generated by the blades of the turbine.

12 Claims, 3 Drawing Sheets

DIFFUSER

BACKGROUND OF THE INVENTION

1. Field of the Invention

The present invention relates generally to devices for the transformation of part of the kinetic energy of a moving fluid into pressure of the fluid. More particularly, the invention concerns a diffuser for use in connection with gas turbines.

2. Discussion of the Invention

A novel and highly successful short subsonic diffuser is described in U. S. Pat. No. 4,029,430 issued to the present inventor. Another example of a novel diffuser is described in U.S. Pat. No. 3,599,431 also issued to the present inventor. Because of the pertinence of these two patents, and because the present invention comprises an improvement over the teachings of these patents, both U.S. Pat. No. 3,599,431 and 4,029,430 are incorporated herein as though fully set forth in this application.

U.S. Pat. No. 4,029,430 describes an extremely efficient diffuser which can recover kinetic energy in a gas stream and convert it to an increase of pressure in the duct. This means that the pressure at the exit of the duct is higher than at the inlet, while the gas velocity there is lower. If the exit of the duct is at atmospheric pressure, the pressure at the inlet is lower than atmospheric and becomes lower still if the gas at the inlet carries substantial kinetic energy and if the diffuser can convert this energy efficiently into a pressure increment.

It is, of course, well known that gas turbines operate by expanding a gas stream from a high pressure in the combustor down to an end pressure at the exit of the last stage of the turbine and extracting as much kinetic energy as practicable from the gas stream. However, energy extraction is never complete, and a certain fraction of energy remains in the gas, which moves with considerable speed at the exit at the last stage of the turbine, typically with a Mach number of on the order of 0.5. The diffuser attempts to recover some of this energy by increasing the pressure increment from the exit of the last stage to the final exit to the atmosphere. A more efficient diffuser generates a larger pressure increment, and since the final exit pressure is constant (the atmosphere), it lowers the pressure downstream from the last stage of the turbine. This in turn increases the pressure drop from the exit of the combustor across the stages of the turbine and consequently increases the total energy available for extraction by the turbine.

The commercial value of a highly efficient diffuser is substantial. For example, in the range of between Mach 0.5 to atmosphere, a diffuser, which is about 90 percent efficient, can increase the fuel efficiency of the turbine by three to five percent. These types of increases in fuel efficiency have been demonstrated by the physical embodiments of the inventions described in U.S. Pat. No. 4,029,430 ('430). However, the diffuser described in the aforementioned patent is not well suited for use in a gas turbine because the gas turbine typically has an inner wall as well as an outer wall on which a boundary layer develops and can become detached. Such a construction cannot readily be accommodated by the embodiments of the '430 patent. It is this drawback of the inventions of the '430 patent, along with other drawbacks of the prior art, which the present invention seeks to overcome.

SUMMARY OF THE INVENTION

It is an object of the present invention to provide a diffuser apparatus for use in connection with gas turbines which will markedly increase the fuel efficiency of the turbine.

More particularly, it is an object of the present invention to provide a diffuser apparatus which is suitable for use with a gas turbine having both inner and outer walls on which a boundary layer develops and can become detached.

Another object of the invention is to provide a diffuser apparatus of the aforementioned character in which significant amounts of kinetic energy of the turbine, which is typically lost, is recovered and put to beneficial use.

Another object of the present invention is to provide a diffuser apparatus as described in the preceding paragraphs which includes strategically located capture means for capturing a portion of the high velocity gas stream of the gas turbine in the area of maximum velocity and redirecting it through a plurality of spaced apart injector slots provided in both the inner and outer walls of a shroud which is positioned relative to the turbine in a manner to capture the high velocity gas stream generated by the blades of the turbine.

Another object of the invention is to provide a diffuser apparatus of the class described which embodies no moving parts, is of a simple construction and is highly efficient in operations.

DESCRIPTION OF THE INVENTION

Figure 1:
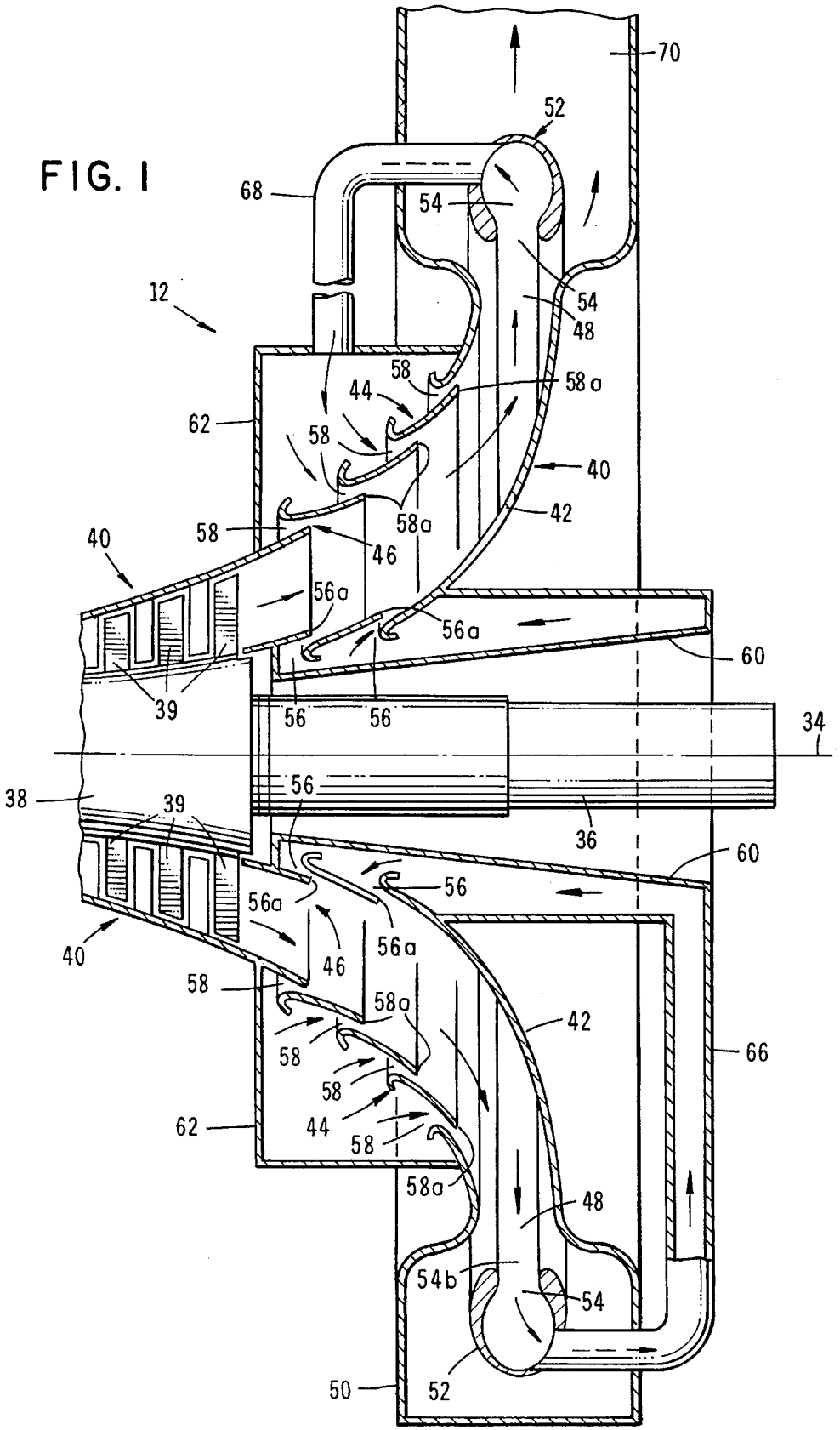
FIG. 1 is a side-elevational, cross-sectional view of one form of diffuser structure of the present invention coupled with a gas turbine of conventional construction.
Figure 2:
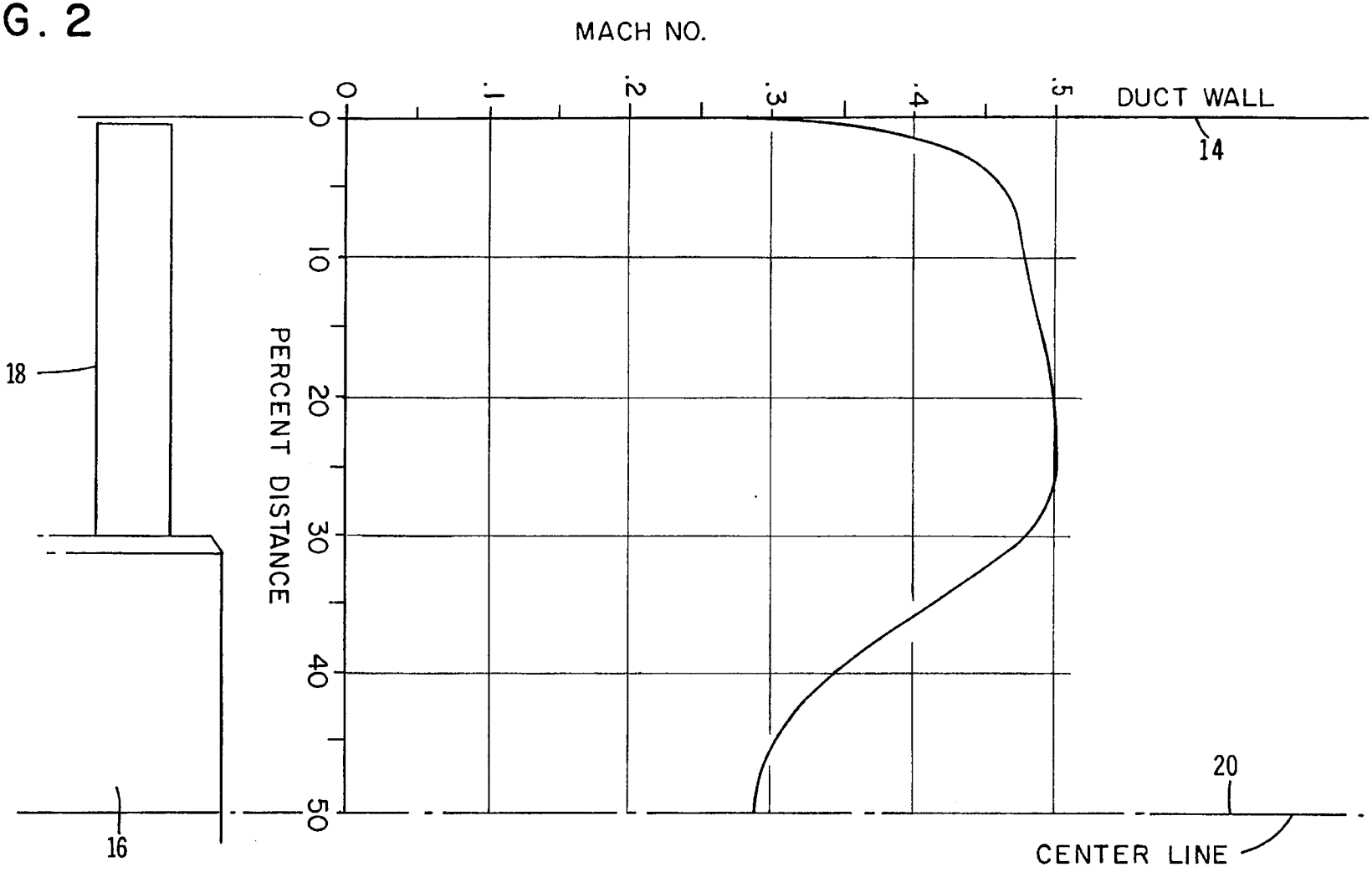
FIG. 2 is a diagrammatic, graphical, side-elevational view showing the typical exhaust velocity distribution exhibited by a prior art, commercial turbine.

Referring to the drawings and particularly to FIG. 1, one form of the diffuser structure of the present invention is there shown and generally designated by the numeral 12. In FIG. 2, the typical exhaust velocity distribution exhibited by a conventional turbine is shown. In this regard it is, of course, well known that the last stage of a gas turbine discharges hot, turbulent gas through an area defined by the span of the last stage blades extending from a hub to which the blades are fastened to a shroud or duct located in close proximity with the tip of the blades. The discharge area is typically annular in shape and the speed of the exhaust gas is highest at the center of the span between hub and duct and is zero along the duct itself (see FIG. 2). The axial component of the velocity is zero along the surface of the hub, but the tangential component typically takes on some of the rotational speed of the hub, so that some swirl is usually present in the exhaust system. This velocity distribution carries a large amount of unused kinetic energy that eventually is lost to the atmosphere via the exhaust stack of the turbine.

Referring particularly to FIG. 2, the typical exhaust velocity distribution of a commercial turbine, as measured a short distance downstream of the plane of the last stage is there shown. In FIG. 2 the duct or shroud is identified by the numeral 14, the hub by numeral 16, the blades of the last stage of the turbine by numeral 18 and the center line of the structure by the numeral 20.

It is readily apparent that the performance of a turbine of the character discussed in the preceding paragraphs can be improved if significant amounts of the kinetic energy, which is typically lost, is recovered and put to beneficial use. A primary object of the present invention is to provide a diffuser which will effectively do just this.

As previously mentioned, a diffuser of the type described in the '430 patent cannot satisfactorily fulfill the aforementioned objective because the diffuser there described collects the recirculating gas by means of a scoop located on the axis of symmetry of a cylindrical or conical duct.

As clearly indicated in FIG. 2, since the gas flowing near the axis of the turbine is in the shadow of the hub, it carries very little kinetic energy. Accordingly, the peculiar velocity distribution of the exhaust gas of the turbine cannot be effectively exploited with a diffuser of the character described in the '430 patent.

This problem can be solved by observing that the stream tubes shown in FIG. 1 of the '430 patent comprise a family of surfaces of revolution with a meridional profile given by a cubic hyperbola wherein parameter "c" identifies a particular curve in the family (see equation 1 of the '430 patent). A suitable choice of parameter "c" can place the stream surface in coincidence with the shroud diameter of the turbine at a plane just downstream of the last stage, whereas another choice for this parameter can place the corresponding stream surface in coincidence with the hub diameter in the same plane. The geometry of flow confined between these two surfaces is then identical to that of the flow between the two analogous surfaces in the diffuser described in the '430 patent, unaffected by the fact that there is no flow inside of the inner surface (downstream of the hub). Metal walls placed along the stream surfaces will cause the flow to develop a pressure increment identical to that observed in the case of a full-flow diffuser, so long as the boundary layer remains attached to both walls.

The resulting static pressure distribution along the wall which is the continuation of the shroud is identical to that existing along the corresponding wall of the full-flow diffuser, and the boundary layer can be maintained attached in the manner disclosed in the '430 patent, provided a suitable source of high pressure gas can be supplied. The flow along the inner wall, that is, the continuation of the hub of the turbine, has no counterpart in the full-flow diffuser, and the pressure distribution has different characteristics. In particular, the static pressure increases up to the point where the cubic hyperbola defining the stream surface is tangent to the ellipse defining a constant pressure surface (point T in FIG. 1 of the '430 patent) and decreases thereafter. Consequently the adverse pressure gradient is much stronger than along the outer wall, between the inlet to the diffuser and point T, and then becomes favorable between point T and the outlet of the diffuser, where the cubic hyperbola of the inner wall crosses the final ellipse corresponding to atmospheric pressure at the discharge of the diffuser.

Figure 3:
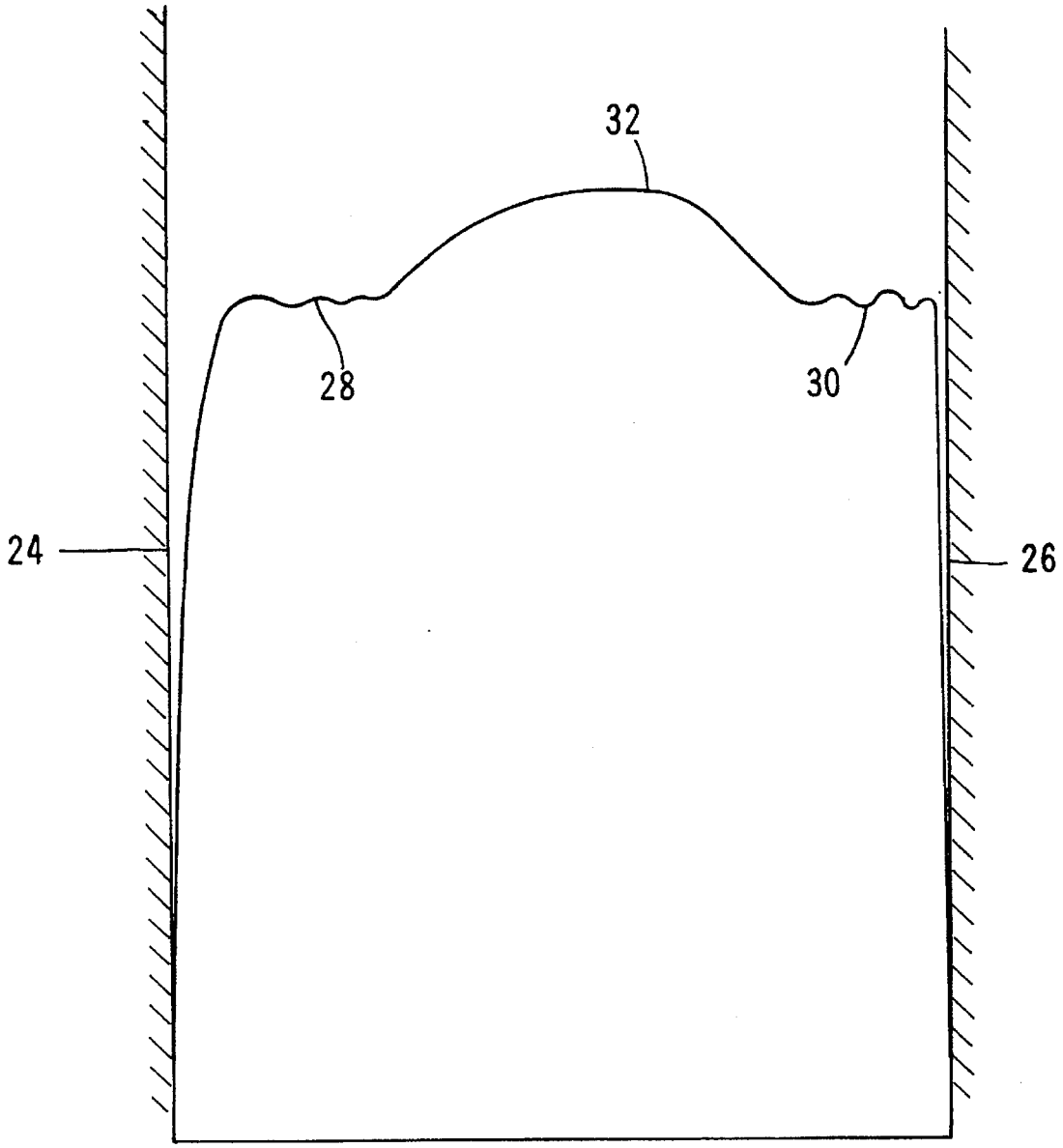
FIG. 3 is a diagrammatic, graphical, cross-sectional view showing an exhaust velocity distributed between the inner and outer walls of a diffuser of the character shown in FIG. 1.

Assuming that a suitable source of high pressure gas can be found, slots can be provided along the inner wall between the inlet to the diffuser and point T, but are not needed between point T and the end of the diffuser. Referring now to FIG. 3, it can be seen that, at the exit of the diffuser, the velocity distribution between the two walls appears is as shown in FIG. 3, where the outer wall is identified by the numeral 24 and the inner wall is identified by the numeral 26. The ripple left over by the wakes of the slots along the outer wall is identified by the numeral 28, while the ripple left over by the wakes of the slots along the inner wall, as modified by the unslotted portion between point T and the exit is identified by the numeral 30. The high velocity region translated from the high velocity region at the center of the span of the turbine blades is identified by the numeral 32.

This velocity distribution corresponds to a qualitatively similar distribution of the total pressure, which has a maximum near the center of the interval between the two walls. A portion of this flow can be collected by a scoop and recirculated to the slots on both walls of the diffuser. The scoop, which is preferably of a generally toroidal configuration, must surround the entire discharge area of the diffuser, and be provided with an opening facing the radially outward directed efflux of the diffuser. As shown in FIG. 1, the opening is preferably centered within the high-velocity area of the gas stream.

Referring particularly to FIG. 1, one form of diffuser of the present invention is there shown coupled with a gas turbine of conventional construction. It is to be noted that the diffuser structure is symmetrical about the axis 34 of the turbine. The turbine includes a power shaft 36 which includes rotating hub 38 to which a plurality of outwardly extending turbine blades 39 are affixed. Circumscribing shaft 36 is a diffuser shroud 40 having inner and outer walls 42 and 44 respectively. As indicated in FIG. 1, the inner open mouth 46 of the shroud 40 is disposed proximate blades 39 of the turbine and functions to receive the high velocity gas stream generated by the turbine blades. Shroud 40 also includes an outer discharge area 48 which communicates with a novel collector means shown here as a collector structure 50. A highly novel capture means is disposed interiorly of collector structure 50 and functions to collect a portion of the gases flowing through the shroud. This capture means is here shown as a generally toroidal shaped capture scoop 52 having an uninterrupted inlet 54. Inlet 54 is strategically located so that it directly faces the high velocity region of the gas stream flowing through shroud 40 toward discharge area 48.

Inner wall 42 of shroud 40 is provided with a plurality of injection slots 56 while outer wall 44 is provided with a plurality of injection slots 58. A first plenum 60 circumscribes a portion of the inner wall 42 of shroud 40 and, in a manner presently to be described, functions to feed gases into shroud 40 through injection slots 56. Similarly, a second plenum 62 circumscribes a portion of the outer wall 44 of shroud 40 and functions to feed gases into the shroud 40 via injection slots 58. As indicated in FIG. 1, each of the injection slots 56 and 58 are constructed so as to have a sharp trailing edge **56*a* and 58*a* respectively for introducing a thin sheet of fluid tangential to the respective inner and outer walls of the shroud and into the boundary layer fluid. Reference should be made to columns 6 and 7 of the '430 patent for a more complete discussion of the purpose and effect of the specially configured slots 56 and 58**.

Interconnecting first plenum 60 with toroidal structure 52 is at least one first tube or conduit 66. Interconnecting second plenum 62 with toroidal structure 52 is at least one second tube or conduit 68. With this novel construction, and by way of illustration, conduit 66 supplies gases collected through opening **54*b* of toroidal structure 52 to injection slots 56 while conduit 68 supplies gases collected through opening 54*c* of the toroidal structure to injection slots 58. Exhaust gas from collector 50 is exhausted to atmosphere through an exhaust stack 70. In actual practice a plurality of connecting tubes or conduits can be used to interconnect the plenums and with the toroidal structure 52**.

It is to be understood that a hot-shaft turbine will typically have a power shaft extending through the center of the diffuser in the manner shown in FIG. 1 while a cold-shaft turbine will typically have a power shaft extending from the compressor end. In this latter instance, the power shaft would not extend into the diffuser.

Reference should be made to the '430 patent, which is incorporated herein by reference, for a discussion of the preferred configuration of injector slots 56 and 58 and for a discussion of the flow of high velocity fluid there through so as to effectively control the boundary layers of the inner and outer walls and prevent detachment.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A diffuser apparatus for use in connection with a gas turbine of the character having a rotatable power shaft, a hub provided on said power shaft and a plurality of turbine blades extending from said hub for rotation therewith, a high velocity gas stream exiting the turbine blades, said apparatus comprising:

(a) a shroud circumscribing the power shaft, said shroud having inner and outer walls defining an enclosure having a first open end disposed proximate the turbine blades to receive the high velocity gas stream, and a second discharge end for exhausting gases of said high velocity gas stream, said inner wall of said shroud having first injector slots provided therein and said outer wall of said shroud having second injector slots provided therein;

(b) capture means disposed proximate said second discharge end of said enclosure for capturing a portion of the gases of said high velocity gas stream;

(c) first conduit means for directing a portion of the high velocity gas stream captured by said capture means toward said first injector slots provided in said inner wall of said shroud; and (d) second conduit means for directing a portion of the high velocity gas steam captured by said capture means toward said second injector slots provided in said outer wall of said shroud.

2. A diffuser apparatus as defined in claim 1 in which said capture means comprises a generally toroidal shaped capture scoop.

3. A diffuser apparatus as defined in claim 2 further including collector means circumscribing said discharge end of said shroud for collecting gases flowing therefrom, said generally toroidal shaped scoop being disposed interiorly of said collector.

4. A diffuser apparatus as defined in claim 3 further including:

(a) a first plenum circumscribing at least a portion of said inner wall of said shroud, said plenum having a gas inlet and a gas outlet communicating with said first injector slots; and (b) a second plenum circumscribing at least a portion of said outer wall of said shroud, said second plenum having a gas inlet and a gas outlet communicating with said second injector slots.

5. A diffuser apparatus as defined in claim 4 in which:

(a) said first conduit means comprises a first conduit interconnecting said generally toroidal shaped capture scoop with said gas inlet of said first plenum; and (b) said second conduit means comprises a second conduit interconnecting said generally toroidal shaped capture scoop with said gas inlet of said second plenum.

6. A diffuser apparatus as defined in claim 5 in which said collector means includes an exhaust stack for exhausting gases therewithin to atmosphere.

7. A diffuser apparatus as defined in claim 5 in which each of said first and second injection slots includes a sharp trailing edge for introducing a thin sheet of fluid tangential to the walls of said shroud.

8. A diffuser apparatus for use in connection with a gas turbine of the character having a rotatable power shaft, a hub provided on said power shaft and a plurality of turbine blades extending from said hub for rotation therewith, a high velocity gas stream exiting the turbine blades, said apparatus comprising:

(a) a shroud circumscribing the power shaft, said shroud having inner and outer walls defining an enclosure having a first open end disposed proximate the turbine blades to receive the high velocity gas stream, and a second discharge end for exhausting gases of said high velocity gas stream, said inner wall of said shroud having first injector slots provided therein and said outer wall of said shroud having second injector slots provided therein;

(b) a collector circumscribing said discharge end of said shroud for collecting gases flowing therefrom;

(c) a generally toroidal shaped capture scoop disposed interiorly of said collector, said capture scoop having an opening therein for capturing a portion of the gases of said high velocity gas stream flowing through said shroud;

(d) a first plenum circumscribing at least a portion of said inner wall of said shroud, said plenum having a gas inlet and a gas outlet communicating with said first injector slots;

(e) at least one first conduit interconnecting said capture scoop with said gas inlet of said first plenum;

(f) a second plenum circumscribing at least a portion of said outer wall of said shroud, said second plenum having a gas inlet and a gas outlet communicating with said second injector slots; and (g) at least one second conduit interconnecting said capture scoop with said gas inlet of said second plenum.

9. A diffuser apparatus as defined in claim 8 in which each of said first and second injection slots includes a sharp trailing edge for introducing a thin sheet of fluid tangential to the walls of said shroud.

10. A diffuser apparatus as defined in claim 9 in which said capture scoop is disposed within said collector at a location where the opening therein is centered with respect to the location of highest velocity of high velocity gas stream flowing through said shroud.

11. A diffuser apparatus as defined in claim 9 in which said collector includes an exhaust stack for exhausting gases therewithin to atmosphere.

12. A diffuser apparatus for use in connection with a gas turbine of the character having a rotatable power shaft, a hub provided on said power shaft and a plurality of turbine blades extending from said hub for rotation therewith, a high velocity gas stream existing the turbine blades, said apparatus comprising:

(a) an elongated, generally annular shaped shroud circumscribing the power shaft, said shroud having inner and outer walls defining a high velocity gas flow passageway having a first open end disposed proximate the turbine blades to receive the high velocity gas stream, and a second discharge end for exhausting gases of said high velocity gas stream, said inner wall of said shroud having first injector slots provided therein and said outer wall of said shroud having second injector slots provided therein, each of said first and second injector slots having a sharp trailing edge for tangentially introducing a thin sheet of fluid;

(b) a collector circumscribing said discharge end of said shroud for collecting gases flowing therefrom;

(c) a generally toroidal shaped capture scoop disposed interiorly of said collector, said capture scoop having an opening therein for capturing a portion of the gases of said high velocity gas stream flowing through said shroud, said opening being centered with respect to said high velocity gas stream;

(d) a first plenum circumscribing at least a portion of said inner wall of said shroud, said plenum having a gas inlet and a gas outlet communicating with said first injector slots;

(e) at least one first conduit interconnecting said capture scoop with said gas inlet of said first plenum;

(f) a second plenum circumscribing at least a portion of said outer wall of said shroud, said second plenum having a gas inlet and a gas outlet communicating with said second injector slots; and (g) at least one second conduit interconnecting said capture scoop with said gas inlet of said second plenum.

* * * * *